US009756443B2

(12) United States Patent
Sun et al.

(10) Patent No.: US 9,756,443 B2
(45) Date of Patent: Sep. 5, 2017

(54) SPEAKER MODULE

(71) Applicant: Goertek, Inc., Weifang, ShanDong Province (CN)

(72) Inventors: Hongchao Sun, Weifang (CN); Ye Sun, Weifang (CN)

(73) Assignee: GOERTEK, INC., Weifang, ShanDong Province (CN)

( * ) Notice: Subject to any disclaimer, the term of this patent is extended or adjusted under 35 U.S.C. 154(b) by 0 days.

(21) Appl. No.: 15/300,085

(22) PCT Filed: Mar. 6, 2015

(86) PCT No.: PCT/CN2015/073767
§ 371 (c)(1),
(2) Date: Sep. 28, 2016

(87) PCT Pub. No.: WO2015/172600
PCT Pub. Date: Nov. 19, 2015

(65) Prior Publication Data

US 2017/0180901 A1 Jun. 22, 2017

(30) Foreign Application Priority Data

May 13, 2014 (CN) ..... 2014 2 0243507 U

(51) Int. Cl.
*H04R 5/02* (2006.01)
*H04R 31/00* (2006.01)
*H04R 1/06* (2006.01)
*H04R 9/06* (2006.01)

(52) U.S. Cl.
CPC ..... *H04R 31/006* (2013.01); *H04R 1/06* (2013.01); *H04R 9/06* (2013.01)

(58) Field of Classification Search
CPC .... H04R 1/345; H04R 25/604; H04R 31/006; H04R 9/047; H04R 1/2842
USPC ..... 381/87, 332–333, 335
See application file for complete search history.

(56) References Cited

FOREIGN PATENT DOCUMENTS

CN 202374407 8/2012

OTHER PUBLICATIONS

PCT/CN2015/073767, Written Opinion dated May 29, 2015 (5 pages) and English Translation (4 pages).

*Primary Examiner* — George Monikang
(74) *Attorney, Agent, or Firm* — Boyle Fredrickson, S.C.

(57) ABSTRACT

Disclosed is a speaker module which relates to the technical field of electroacoustic products and comprises shells (10, 20), wherein a loudspeaker unit (30) is accommodated in the shells (10, 20); an elastic piece (40) is provided on the loudspeaker unit (30); and a conductive structure (22) electrically connected to the elastic piece (40) is provided on the shells (10, 20), the conductive structure (22) is fitted with shell surfaces of the shells (10, 20), one end of the conductive structure (22) is located inside an inner cavity of the module and is electrically connected to the elastic piece (40), the other end of the conductive structure (22) is located outside the inner cavity of the module and is electrically connected to a terminal circuit, and the conductive structure (22) is made of a metal material. The speaker module has advantages such as high stability of a conductive path, a simple structure, a simple and practicable assembling process, and solves technical problems in the prior art that the conductive path of the loudspeaker module is unstable, and the assembling process is complex.

8 Claims, 1 Drawing Sheet

SPEAKER MODULE

FIELD OF THE DISCLOSURE

The present disclosure relates to the technical field of electro-acoustic products, and particularly to a speaker module.

BACKGROUND ART

The speaker module is an important acoustic component in an electronic terminal, and may convert electrical energy into acoustic energy and irradiate it out. A current speaker module comprises a shell, and a cavity formed by the shell receives a micro-speaker unit and an FPCB (Flexible Printed Circuit Board) for electrically connecting the speaker unit with a module external circuit (namely, a circuit in the electronic terminal). An end of the FPCB is electrically connected with the speaker unit by welding, and the other end thereof is electrically connected with a circuit board connection terminal of an electronic terminal via a pad, thereby achieving an ON circuit between the speaker unit and an electronic terminal circuit. As the FPCB is made from a flexible material and apt to failure situations such as line disconnection and deformation, the ON circuit is unstable, and those skilled in the art need to reinforce the FPCB to avoid the failure of the FPCB, thereby increasing the difficulty in producing the speaker module, which is mainly manifested in the following points:

1) A reinforcing plate needs to be stuck to a rear side of the FPCB to increase mechanical strength, thereby increasing assembling steps of the module and making the assembling process of the module complicated;

2) A plurality of positioning posts need to be designed on the shell of the module, and then the FPCB is fixed by a hot melting process, which not only increases the assembling steps of the module but also makes the structure of the module shell complicated, and further increases the difficulty in assembling the module;

3) As for a fully-sealed module, a glue needs to be applied around a periphery of an exit of the FPCB.

As known from the above, the FPCB used as a conduction circuit between the speaker unit and the terminal circuit not only exhibits undesirable circuit stability but also makes the structure of the module shell become complicated, and meanwhile increases assembling steps of the module as well as the assembling difficulty.

SUMMARY OF THE DISCLOSURE

A technical problem to be solved by the present disclosure is to provide a speaker module, wherein a conduction circuit between a speaker unit of the speaker module and a terminal circuit has a high stability, the module is simple in structure, assembling steps are convenient and easy to implement, and, the production efficiency is high;

To solve the above technical problem, the present disclosure employs the following technical solutions:

A speaker module, comprising a shell receiving therein a speaker unit, wherein the speaker unit is provided with an elastic piece, a conductive structure electrically connected with the elastic piece is disposed on the shell, the conductive structure is fined with a shell surface of the shell, one end of the conductive structure is located inside an inner cavity of the module and electrically connected to the elastic piece, the other end of the conductive structure is located outside the inner cavity of the module and electrically connected to a terminal circuit, and the conductive structure is made of a metal material.

Wherein the shell comprises at least two shells which are engaged together, the conductive structure is fitted on a surface on a side of one of the shells adjacent to the module inner cavity; the shell provided with the conductive structure is made from a plastic material, a lateral edge thereof is provided with an outward extension extending outward, and a portion of the conductive structure located external of the inner cavity of the module is fitted with the outward extension.

Wherein a sidewall of the shell provided with the conductive structure on the side where the outward extension is disposed is an inclined plane.

The present disclosure achieves the following advantageous effects after employing the above technical solutions:

The speaker module according to the present disclosure comprises a shell, the speaker unit is received in the shell, the speaker unit is provided with an elastic piece, the shell is provided with the conductive structure whose one end is electrically connected with the elastic piece, the conductive structure is fined with the shell surface of the shell, the other end of the conductive structure is electrically connected with the terminal circuit, and the conductive structure is made of a metallic material. The conductive structure of the metallic material has a greater mechanical strength than the FPCB and is not apt to deformation or line disconnection, so the reinforcing plate needn't to be stuck to increase the mechanical strength, and a plurality of positioning posts needn't to be provided on the shell to ensure welding and lead out precision, thereby simplifying the structure of the module shell, reducing assembling steps of the module and reducing an assembling difficulty of the module. The conductive structure is fitted with a shell surface of the shell, when sealing the shell, a glue need not to be applied around a periphery of an exit. This further simplifies the assembling steps of the module.

To conclude, the present disclosure solves technical problems in the prior art that the conductive path of the loudspeaker module is unstable, and the assembling process is complicated; the speaker module has advantages such as high stability of the conductive path, a simple structure, a simple and practicable assembling process.

The above depictions are only generalization of technical solutions of the present disclosure. To make technical means of the present disclosure more apparent, so that the present disclosure may be implemented according to the content of the description; furthermore, to make the above and other objects, features and advantages of the present disclosure more apparent, specific embodiments of the present disclosure will be illustrated as follows.

BRIEF DESCRIPTION OF DRAWINGS

Various other advantages and merits will become apparent to those having ordinary skill in the art by reading through the following, detailed description of preferred embodiments. Figures are only intended to illustrate preferred embodiments and not construed as limiting the present disclosure. In the figures.

In the figures, the reference number 10 denotes a first shell, 12 a sound hole, 20 a second shell, 22 a conductive structure, 24 an outward extension, 30 a speaker unit and 40 an elastic piece.

DETAILED DESCRIPTION OF PREFERRED EMBODIMENTS

In the depictions hereunder, some exemplary embodiments of the present disclosure are described only in an illustrative manner. Undoubtedly, those having ordinary skill in the art may appreciate that embodiments may be modified in various different manners without departing from the spirit and scope of the present disclosure. Hence, the figures and depictions are illustrative in essence and not intended to limit the protection scope of claims. In the description, identical reference numbers denote identical or like parts.

The present disclosure will be further illustrated with reference to figures and embodiments.

Embodiment 1

Figure 1:
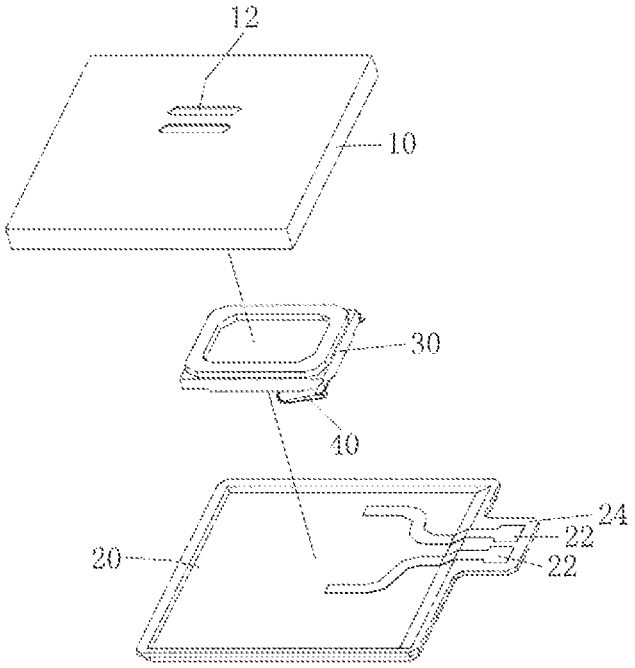
FIG. 1 is an exploded structural schematic view of a speaker module according to the present disclosure.
Figure 2:
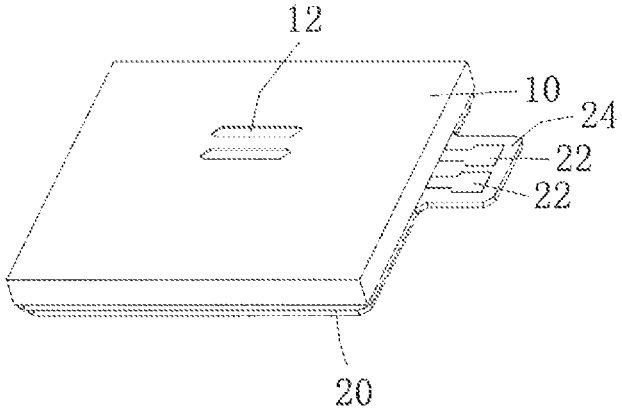
FIG. 2 is an assembled view of FIG. 1.

As jointly shown in FIG. 1 and FIG. 2, a speaker module further mounted in an electronic terminal (not shown) comprises a first shell 10 and a second shell 20 engaged together, a speaker unit 30 is received in a space surrounded by the first shell 10 and second shell 20, the speaker unit 30 comprises a vibration system and a magnetic circuit system (not shown in the figures), the first shell 10 is adjacent to the vibration system, the first shell 10 is provided with a sound hole 12, and the second shell is adjacent to the magnetic circuit system. Preferably, both the first shell 10 and second shell 20 are plastic shells.

Figure 3:
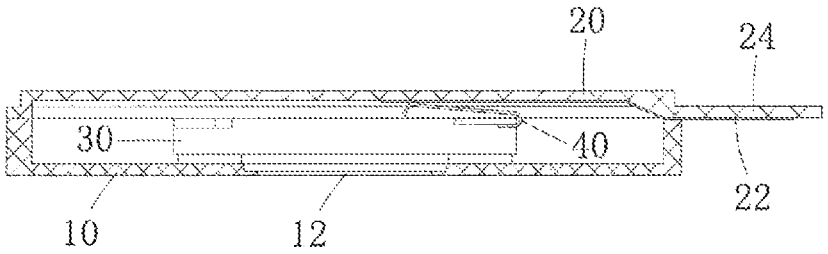
FIG. 3 is a sectional view of a speaker module according to the present disclosure.

As jointly shown in FIG. 1 and FIG. 3, the speaker unit 30 is provided with two elastic pieces 40, the second shell 20 is provided with two conductive structures 22, and each of the conductive structures 22 is a sheet-shaped metallic material. An end of the elastic piece 40 is electrically connected to a voice coil (not shown) in the speaker unit 30, the other end of the elastic piece 40 is electrically connected with the conductive structure 22, and two elastic, pieces 40 are respectively connected with corresponding conductive structures 22. The conductive structures 22 is fitted on a surface of a side of the second shell 20 adjacent to the first shell 10. A lateral edge of the second shell 20 is provided with an outward extension 24 extending outward, and a portion of the conductive structure 22 located external of the inner cavity of the module is fitted with the outward extension 24. An end of the conductive structure 22 located in the interior of the module inner cavity is electrically connected with the elastic piece 40, and an end of the conductive structure 22 located external of the module inner cavity is electrically connected with the terminal circuit. The conductive structure 22 of the metallic material has a greater mechanical strength than the FPCB and is not apt to deformation or line disconnection, so the reinforcing plate is not needed to increase the mechanical strength and a plurality of positioning posts need not be provided on the shells to ensure welding and lead out precision; the conductive structure 22 is fitted with the surface of the second shell 20, and a glue need not be applied around a periphery of an exit upon performing sealing between the shells. The conductive structure of a metallic material not only effectively simplifies the structure of the module shells, but also reduces assembling steps of the module, thereby simplifying an assembling process of the module, reducing an assembling difficulty and improving production efficiency.

As jointly shown in FIG. 1 and FIG. 3, a sidewall of the second shell 20 provided with the outward extension 24 is an inclined plane. Since the conductive structure 22 extends along the sidewall from interior to exterior of the module inner cavity, the sidewall in the form of the inclined plane is more conducive to fitting with the conductive structure 22 as compared with the remaining three sidewalls which are vertical planes, and the processing difficulty is lower. As shown in FIG. 1, the conductive structure 22 is fitted with the surface of the second shell 20 in the following several manners:

The first manner: the conductive structure 22 is a metallic line formed on the surface of the second shell 20 by an LDS (Laser Direct Structuring) process.

The second manner: the conductive structure 22 is a metallic patch attached to the surface of the second shell 20.

In this manner, the metallic patch may be stuck to the surface of the second shell 20 via an adhesive; a hot melting post may be disposed on the second shell 20, a hot melting hole mating with the hot melting post is disposed on the metallic patch, then the metallic patch is stuck on the surface of the second shell 20 by the hot-melting process. Such hot-melting fitting, manner appears complicated, as compared with the adhesive-fitting manner, but the conductive structure 22 is fitted with the surface of the second shell 20 more firmly.

The third manner; the conductive structure 22 is a metallic thin sheet, and engaged with the surface of the second shell 20 by injection molding process.

The fourth manner: the conductive structure 22 is a metallic coating primed on the surface of the second shell 20.

Many metallic materials have an electrical conduction property, for example, commonly-used copper, aluminum, iron or silver. The material of the conducive structure is preferably copper foil in the present disclosure as considered from several aspects such as costs, electrical conductivity and weight.

The naming of the first shell and second shell involved in the embodiments is only intended to distinguish technical, features and does not represent a positional relationship and a mounting sequence between the two shells.

Embodiment 2

The present embodiment is substantially identical with Embodiment 1 and different from Embodiment 1 as follows:

The shell of the speaker module comprises a first shell, a second shell and a third shell which are engaged together, wherein the second shell is an annular shell, and the first shell and third shell are respectively engaged at both ends of the second shell. A sound exit hole of the speaker module is disposed on the first shell, the first shell is adjacent to the vibration system of the speaker unit, the third shell is adjacent to the magnetic circuit system of the speaker unit, and the conductive structure is disposed on the third shell.

The naming of the first shell, second shell and third shell involved in the embodiments is only intended to distinguish technical features and does not represent a positional relationship and a mounting sequence among the three shells.

The description only presents detailed illustration of the inventive concept of the present disclosure by taking the speaker module shown in the figures as an example, and this does not mean the protection scope of the present disclosure is only limited to the speaker module of such structure. In fact, the technical solution in which metallic conductive structures in place of the FPCB is provided on the module shell of a plastic material may be applied to a speaker module of any structure. Hence, any speaker module, no matter whether, the speaker module is rectangular, circular or track-shaped or the like, and regardless of the structure of shells of the speaker module and the internal speaker unit, falls within the protection scope of the present disclosure so long as the product goes in a way that the surface of the module shell is fitted with the metallic conductive structures to communicate the speaker unit with the terminal circuit in place of FPCB.

The present disclosure is not limited to the above specific embodiments, and diverse variations devised by those having ordinary skill in the art starting from the above concept without making any inventive efforts all fall within the protection scope of the present disclosure.

What is claimed is:

1. A speaker module, comprising a shell receiving therein a speaker unit, wherein the speaker unit is provided with an elastic piece, a conductive structure electrically connected with the elastic piece is disposed on the shell, the conductive structure is fitted with a shell surface of the shell, one end of the conductive structure is located inside an inner cavity of the module and electrically connected to the elastic piece, the other end of the conductive structure is located outside the inner cavity of the module and electrically connected to a terminal circuit, and the conductive structure is made of a metal material;

wherein the shell comprises at least two shells which are engaged together, the conductive structure is fitted on a surface on a side of one of the shells adjacent to the module inner cavity; the shell provided with the conductive structure is made from a plastic material, a lateral edge thereof is provided with an outward extension extending outward, and a portion of the conductive structure located external of the inner cavity of the module is fitted with the outward extension;

wherein a sidewall of the shell provided with the conductive structure on the side where the outward extension is disposed is an inclined plane.

2. The speaker module according to claim 1, wherein the conductive structure is a metallic line formed on the surface of the shell by a Laser Direct Structuring (LDS) process.

3. The speaker module according to claim 1, wherein the conductive structure is a metallic patch attached to the surface of the shell.

4. The speaker module according to claim 3, wherein the metallic patch is stuck to the surface of the shell via an adhesive, or the metallic patch is stuck on the surface of the shell by a hot-melting process.

5. The speaker module according to claim 1, wherein the conductive structure is a metallic thin sheet injection molded on the surface of the shell.

6. The speaker module according to claim 1, wherein the conductive structure is a metallic coating printed on the surface of the shell.

7. The speaker module according, to claim 1, wherein the shell comprises a first shell and a second shell which are engaged together, and the conductive structure is disposed on the second shell.

8. The speaker module according to claim 1, wherein the shell comprises a first shell, a second shell and a third shell which are engaged together, and the conductive structure is disposed on the third shell.

* * * * *